United States Patent [19]

Pomeroy

[11] 4,167,794

[45] Sep. 18, 1979

[54] BRISTLES AND TOOTHBRUSHES

[76] Inventor: Robert L. Pomeroy, 10 Lathbury Rd., Oxford, England

[21] Appl. No.: 900,217

[22] Filed: Apr. 26, 1978

[51] Int. Cl.[2] ..... A46B 9/04

[52] U.S. Cl. ..... 15/188; 15/167 R

[58] Field of Search ..... 15/16.7 R, 167 A, 110, 15/186, 187, 188, 104.94, 210.5; 128/62 A; 32/50

[56] References Cited

U.S. PATENT DOCUMENTS

| | | | |
|---|---|---|---|
| 1,471,782 | 10/1923 | Eckart | 15/181 X |
| 1,946,283 | 2/1934 | Hoffman et al. | 15/188 |
| 2,354,780 | 8/1944 | Stewart | 128/62 A |
| 2,432,264 | 12/1947 | Tyler | 15/159 A |
| 2,548,255 | 4/1951 | Cressler | 15/159 A |
| 2,637,870 | 5/1953 | Cohen | 15/188 |
| 3,103,027 | 9/1963 | Birch | 15/110 |
| 3,214,777 | 11/1965 | Kutik | 15/187 |
| 3,230,562 | 1/1966 | Birch | 15/187 X |

FOREIGN PATENT DOCUMENTS

| | | | |
|---|---|---|---|
| 1371636 | 6/1964 | France | 15/159 A |
| 318019 | 9/1929 | United Kingdom | 15/210.5 |

*Primary Examiner*—Peter Feldman

*Attorney, Agent, or Firm*—James C. Wray

[57] ABSTRACT

Bristles have integrally formed flattened and extended distal ends which terminate in distal outer edges for cleaning teeth. The bristles are arranged in toothbrushes with edges aligned with a longitudinal direction of the toothbrush and with the edged bristles positioned along lateral areas of the toothbrush and extending angularly outward therefrom.

24 Claims, 15 Drawing Figures

FIG. 1
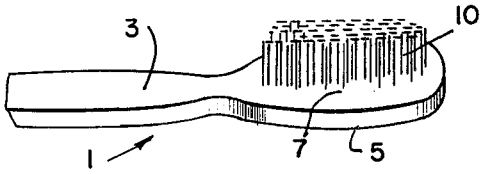
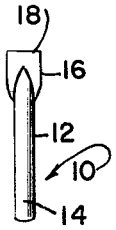
FIG. 2
FIG. 3
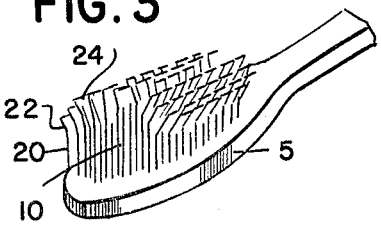
FIG. 4
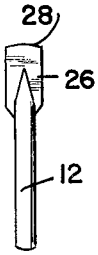
FIG. 5
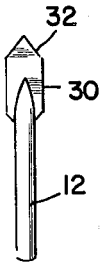
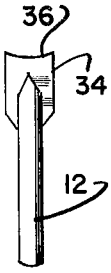
FIG. 6
FIG. 7
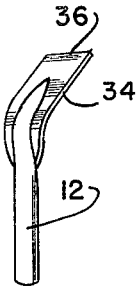
FIG. 8
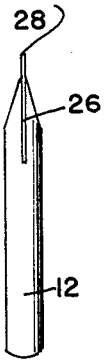
FIG. 9
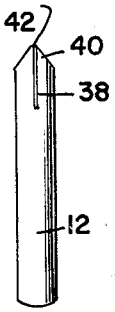
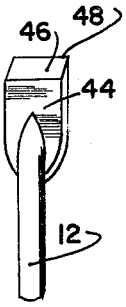
FIG. 10
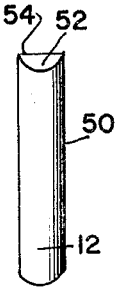
FIG. 11
FIG. 12
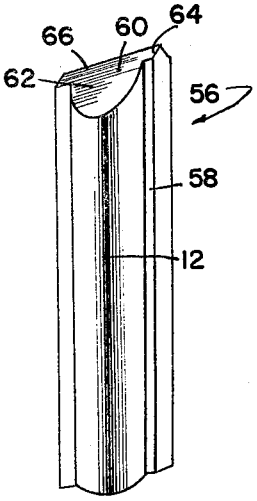
FIG. 13
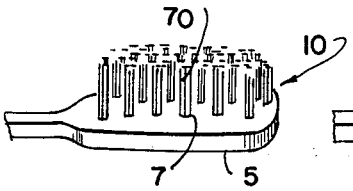
FIG. 14
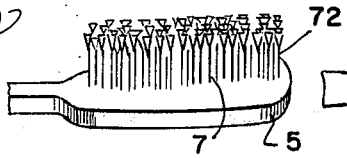
FIG. 15
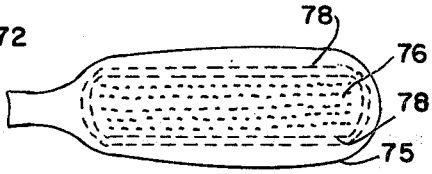

BRISTLES AND TOOTHBRUSHES

BACKGROUND OF THE INVENTION

Varied forms of bristles, especially bristles used in combination with toothbrushes are known.

Examples of such bristles and toothbrushes having such bristles are found in Class 15, Brushing and Scrubbing, especially in subclasses 159 and 167, of official patent classifications in the United States Patent and Trademark Office.

Problems exist in brushes now in use, specifically toothbrushes, in that the bristles do not provide sufficient cleaning action.

After one brushes his teeth with a conventional toothbrush, for example, plaque may remain on the surfaces of teeth. Evidence of the remainder plaque after a thorough brushing may be generated by dragging a length of dental floss across surfaces of individual teeth or by pushing a surface in a manner of a shovel across tooth surfaces. The material which is removed by the floss and by the edge of the card-like object is plaque which remains on the teeth surfaces after brushing. It becomes obvious that brushing with conventional brushes is not satisfactory.

The problem with conventional brushes is that the rounded ends of conventional nylon bristles or the split fibrous ends of natural bristles either do not contact sufficient teeth area to remove substantially all the plaque or do not contact the tooth area with sufficient force or sufficient controlled directions to remove substantially all of the plaque on surfaces of teeth which are accessible to brush bristles.

SUMMARY OF THE INVENTION

The present invention overcomes the problems of the prior art by providing bristles and especially bristles for toothbrushes and bristles in combination with toothbrushes which have terminal shovel-like elements which contact accessible surfaces of teeth and shovel plaque from the entire accessible surface area.

In the preferred form of the invention, the bristles are constructed as ordinary bristles having shafts with conventional round cross section and having shovel-like distal ends with terminal edges transverse to directions of the shafts to shove, lift, and shovel plaque from surfaces of the teeth.

In a preferred form of the invention, the bristles are looped and gathered in tufts and the looped portions of the tufts are mounted in openings in the head of a brush in conventional manners such as by chemical and thermal bonding or by heat or friction welding. Free ends of the bristles are provided with shovel-like elements, which preferably are formed from integral flattened extensions of the distal ends of the bristles. The shovel-like elements have tooth contacting outer edges which are formed in straight, curvilinear, or angular modifications.

In the preferred embodiment of the invention, the bristle tapers uniformly into an outward extended integrally formed shovel-like element which has a straight outer edge perpendicular to the stem of the bristle. The tips of the bristles are flat and shovel-shaped rather than round. The shovel-shape actually lifts and shovels plaque from the teeth far more effectively than normal bristles.

In preferred forms of the invention, conventional bristles of selected varied stiffnesses are employed. The rigidity of the shaft and the shovel-shaped elements are selected as in conventional toothbrushes to satisfy the wishes of the user and to provide a brush with bristle stiffness as recommended by his dentist.

Bristles of the present invention are manufactured by conventional extrusion processes from heat flowable materials such as nylon.

Immediately upon extrusion, the filaments, still in a flowable state are squeezed between opposed dies having cavities of the desired shovel-like shape.

Preferably the dies have end-to-end shovel-like shapes and cut off elements are associated with the dies to sever and shape the terminal edges. Cooling of the filaments with the extended shovel-like portions may be accomplished before severing and beveling the edges. Preferably, immediately following cooling, severing and beveling, parallel double ended elements are bent and collected in tufts whereupon they are inserted in openings in a toothbrush head. Single double ended elements may be medially bent and the bent end inserted in toothbrush head openings.

In a preferred embodiment of the invention, the extruded elements are widened into double end to end shovel portions and the shovel portions are medially severed and beveled, and the filament shafts are severed between double portions to form single bristle elements which are inserted singularly into openings in toothbrush heads.

Preferably edges of the shovel-like elements are aligned with a longitudinal direction of the toothbrush. Shovel-like elements at outer and inner ends of the toothbrush head may be turned and oriented in opposite coves following edges of the toothbrush to provide shoveling elements for pushing along inner surfaces of the frontal incisors, and along grinding faces of molars.

OBJECTS OF THE INVENTION

One object of the invention is the provision of bristles for brushes each with a shaft having a proximal end for mounting in a head of a brush and having a distal end for spacing from the head of the brush, means on the distal end for extending the distal end laterally in opposite directions, the means having an edge extending transverse to the shaft.

Another object of the invention is the provision of a round bristle with an edge perpendicular to the shaft.

A further object of the invention is the provision of having integrally formed opposite lateral extensions of the distal ends of the bristles, the extensions being formed as generally flattened distal ends of the bristles.

Another object of the invention is the provision of a bristle with a shaft extending close to a transverse edge and wherein the transverse edge and shaft are sloped transverse to a direction of the extensions thereby providing a sharpened edge.

A further object of the invention is the provision of a bristle wherein lateral extensions extend longitudinally beyond a continued cross section of the shaft and wherein a distal edge is beveled transverse to a direction of the extensions thereby providing a sharpened edge.

Another object of the invention is the provision of a bristle with a distal edge which is substantially a straight line.

A further object of the invention is the provision of a bristle with a curved sharpened distal edge.

Another object of the invention is the provision of a bristle wherein the distal end of a shaft is tapered into lateral extensions, whereby the extensions and tapered end of the shaft uniformly deflects around a radius transverse to a direction of the extensions.

A further object of the invention is the provision of a bristle shaft which is sloped at the distal end to form a transverse edge.

Another object of the invention is the provision of a bristle having distal and lateral extensions on the bristle extending in first and second opposite senses of direction forming a unitary edge with the distal edge of the shaft.

Another object of the invention is the proision of a bristle as described formed as a unitary extrusion from its proximal to its distal ends.

Further objects of the invention are the provisions of brush heads having opening means in the brush heads for receiving the bristles as described above.

Another object of the invention is the provision of a toothbrush wherein the bristles have aligned sharpened edges at distal ends thereof.

Another object of the invention is the provision of a toothbrush as described wherein distal edges of the bristles are aligned generally parallel to a longitudinal direction of the toothbrush.

The invention has as another object the provision of bristles as described above mounted in holes near lateral edges of a bristle mounting face of the toothbrush.

A further object of the invention is the provision of a toothbrush wherein bristles as described above mounted in openings adjacent lateral edges of a bristle holding face of the toothbrush extend generally perpendicular from the toothbrush and then angularly outward to aligned distal edges which are disposed generally angularly outward from shafts of the bristles.

These and other and further objects and features of the invention are apparent in the disclosure which is the above and ongoing specification, including the claims, and the drawings.

BRIEF DESCRIPTION OF THE DRAWINGS

FIG. 1 shows a toothbrush having bristles with shovel-shaped tips.

FIG. 2 is a detail of the bristles used in this toothbrush shown in FIG. 1.

FIG. 3 shows a toothbrush with bristles similar to the bristles in FIG. 1 with the exception that shovel-shaped tips of outer bristles are turned outwardly.

FIG. 4 is a detail of a modified form of a bristle with a convex edge on the shovel-shaped tip.

FIG. 5 is a modified form of a bristle with an angular edge.

FIG. 6 is a modified form of a bristle with a concave edge.

FIG. 7 shows a detail of a bristle such as that shown in FIG. 2 in which the shovel-shaped tip has been bent for use along the edges of a brush as shown in FIG. 3.

FIG. 8 is a side elevation of a bristle such as the bristle shown in FIG. 2.

FIG. 9 is the side elevation of a bristle in which the beveled shaft end extends to the outer edge of the bristle.

FIG. 10 is a detail of the bristle with a beveled edge on the shovel-like tip.

FIG. 11 is a detail of an alternate form of bristle having its end beveled toward a medial longitudinal edge.

FIG. 12 is a detail of an alternate form of bristle having longitudinally extended flanges.

FIG. 13 shows a toothbrush in which shovel tipped bristles are gathered in tufts and are mounted in openings in the brush head.

FIG. 14 shows a toothbrush in which bristles with shovel-shaped tips are mounted individually in a toothbrush head.

FIG. 15 is a plan view of a toothbrush head in which bristles having shovel-shaped tips are positioned exteriorly of conventional centrally located bristles.

DETAILED DESCRIPTION OF THE DRAWINGS

Referring to FIG. 1, a toothbrush is generally indicated by the numeral 1. A conventional handle 3 is integrally formed with a head 5. Openings 7 in the head receive bristles 10 having shovel-shaped tips.

Referring to FIG. 2, each bristle 10 has a shaft 12 which may be of conventional round form. A proximal end 14 of shaft 12 is provided for mounting in openings in a brush lead.

Shovel-shaped tip 16 is integrally formed on a distal end of the bristle shaft 12 and edge 18 is formed transverse and generally perpendicular to an axis of the bristle shaft 12.

As shown in FIG. 3, toothbrush head 5 has bristles 10 mounted in a central portion of the head. Along the outer portions of the head are mounted bristles 20 which are similar to bristles 10 with the exception that the shovel-shaped tips 22 are directed outwardly and terminate in longitudinally oriented but outward directed edges 24.

FIG. 4 shows an embodiment of a bristle in which the shovel-shaped tip 26 on the distal end of shaft 12 terminates in a convexly curved edge 28.

In a related bristle shown in FIG. 5, the shovel-shaped tip 30 terminates in an angular outer edge 32.

Shovel-shaped tip 34 on shaft 12 terminates outwardly in a concave edge 36, as shown in FIG. 6.

As shown in FIG. 7, when the bristles are flexed, maximum flexure occurs as a radius of the shovel-shaped tip 34.

FIG. 8 is a side elevation of the bristle shown in detail in FIG. 2.

FIG. 9 is a side elevation of a bristle in which the distal end of the shaft 12 which is beveled at 40 coincides with the center portion of the outer edge 42. The lateral extensions 38 which form the shovel-like tip may be formed of material which is flowed away from the beveled portion 40 of the bristle or may be formed of separate material which is attached laterally at opposite sides of the distal end of the bristle shaft 12.

In FIG. 10, the shovel shaped tip 44 is beveled 46 in one direction toward the outer edge 48.

A modified form of bristle 50 is shown in FIG. 11. Shaft 12 has oppositely beveled facets 52 at its distal end to form a medial edge 54. The beveled facets 52 and the medial edge 54 would operate to lift plaque from tooth surfaces.

In another form of the invention as shown in FIG. 12, bristle 56 has a shaft 12 on which are integrally formed flanges 58. The distal end 60 of bristle 56 is beveled with oppositely sloped facets 62 on the ends of shaft 12 in common planes with bevels 64 and flanges 58 leading to a central edge 66.

In this form of the invention, the bristle 56 may be extruded with integrally formed flanges 58 on shaft 12 and distal end 60 may be severed in the bevel shape or may be abraded to the bevel shape to form the edge 66.

As shown in FIG. 13, bristles 10 are gathered in tufts 70 which are mounted in holes 7 in bristle head 5.

Preferably the individual bristles are mounted in holes 7 as shown at 72 in FIG. 14.

In one form of the invention, individual bristles 78 having shovel-shaped tips are mounted in holes along outer edges of toothbrush head 75, and conventional bristles 76 are mounted in holes near the center of the bristle head. The bristles with shovel-shaped tips may continue around the entire head, fully enclosing the conventional bristles 76. In that case, the shovel-like tips and the edges are oriented parallel to the edge of the bristle head so that the shovel-like tips may shovel plaque from all surfaces of the teeth.

In use, the toothbrush may be placed alongside teeth and rotated slightly toward the teeth to cause the bristles to flex with the shovel-shaped tips urging the outer edges against the teeth. Then the brush is moved along the teeth toward the biting surface without rotation shoveling plaque from the surface of the teeth.

Although the invention has been described with reference to specific embodiments, it will be obvious to those skilled in the art that modifications and variations of the invention can be constructed without departing from the scope of the invention. The scope of the invention is defined in the following claims.

I claim:

1. A toothbrush comprising a handle having a head, a plurality of bristles, each bristle having circular cross-section shaft having a proximal end mounted in the head of the toothbrush and having a distal end spaced from the head of the toothbrush, shovel means on the distal end extending the distal end laterally in opposite directions from the shaft for shovelling plaque from teeth, the shovel means having a planar shovel blade axially centered on the shaft and having lateral extensions extending laterally outward from the shaft and a shovel blade edge extending perpendicularlly to the shaft wherein the shovel means comprises integrally formed opposite lateral extensions of the distal end of the bristle, the extensions being formed as a generally flattened distal end of the bristle, thereby integrally forming a shovel blade from the bristle at its distal end.

2. The bristle of claim 1 wherein the shaft extends close to the transverse edge and wherein the transverse edge and shaft are sloped transverse to a direction of the extensions thereby providing a sharpened edge.

3. The bristle of claim 3 wherein the lateral extensions extend longitudinally beyond a continued cross section of the shaft and wherein the edge is beveled transverse to a direction of the extensions thereby providing a sharpened edge.

4. The bristle of claim 1 wherein the edge is beveled transversely to a direction of the extensions.

5. The bristle of claim 4 wherein the edge is beveled in angularly sloping opposite directions.

6. The bristle of claim 4 wherein the edge is beveled in a unitary sloping direction.

7. The bristle of claim 1 wherein the edge is substantially a straight line.

8. The bristle of claim 1 wherein the edge is curved.

9. The bristle of claim 8 wherein the edge is convexly curved.

10. The bristle of claim 8 wherein the edge is concave.

11. The bristle of claim 10 wherein the distal end of the shaft is tapered, whereby the extensions and tapered end of the shaft uniformly flex around a radius transverse to a direction of the extensions.

12. The bristle of claim 3 wherein the shaft is sloped at the distal end to form the edge.

13. The bristle of claim 12 wherein the shaft is sloped oppositely at the distal end to form a medially positioned edge.

14. The bristle of claim 12 further comprising lateral extensions on the bristle extending in first and second opposite senses of direction and having distal ends forming a unitary edge with the edge of the shaft.

15. The bristle of claim 14 wherein the bristle is formed as a unitary extrusion from its proximal to its distal ends.

16. The bristle apparatus of claim 3 further comprising a brush head having opening means in the brush head for receiving the bristle.

17. The apparatus of claim 16 further comprising a plurality of similarly formed bristles mounted in openings in the brush head.

18. The apparatus of claim 17 wherein the brush head comprises the head of a toothbrush and wherein the bristles have aligned edges at distal ends thereof.

19. The apparatus of claim 18 wherein the edges at distal ends of the bristles are aligned generally parallel to a longitudinal direction of the toothbrush.

20. The apparatus of claim 19 wherein the bristles comprise unitary bristles mounted singularly in each of plural openings in the brush head.

21. The apparatus of claim 19 wherein the bristles comprise plural groups or tufts of bristles mounted collectively in each of several holes of the brush head.

22. The apparatus of claim 19 wherein the bristles are mounted in holes near lateral edges of a bristle mounting face of the toothbrush.

23. The apparatus of claim 19 wherein bristles mounted in openings adjacent lateral edges of a bristle holding face of the toothbrush head extend generally perpendicular from the toothbrush and then angularly outward to distal ends which are disposed generally angularly outward therefrom.

24. The apparatus of claim 18 wherein the edges at distal ends of the bristles are aligned to follow the general curve of the brush head.

* * * * *